US006012874A

United States Patent [19]

Groneck et al.

[11] Patent Number: 6,012,874

[45] Date of Patent: Jan. 11, 2000

[54] MICROPILE CASING AND METHOD

[75] Inventors: Paul B. Groneck, Tacoma; Thomas A. Amour, Gig Harbor, both of Wash.

[73] Assignee: DBM Contractors, Inc., Federal Way, Wash.

[21] Appl. No.: 08/818,617

[22] Filed: Mar. 14, 1997

[51] Int. Cl.[7] ..... E02D 5/38; E02D 7/30

[52] U.S. Cl. ..... 405/239; 405/249; 405/251

[58] Field of Search ..... 405/233, 238, 405/239, 243, 246, 249, 251, 252.1, 255, 258, 259.1, 259.5, 266, 267

[56] References Cited

U.S. PATENT DOCUMENTS

| | | | |
|---|---|---|---|
| 582,744 | 5/1897 | Jarrett | 405/249 |
| 760,754 | 5/1904 | Poor | 405/251 |
| 1,588,516 | 6/1926 | Barnes | 405/257 |
| 3,354,657 | 11/1967 | Turzillo | 405/257 X |
| 3,757,528 | 9/1973 | Finsterwalder et al. | 405/257 X |
| 4,254,597 | 3/1981 | Feldman et al. | 405/251 X |
| 4,610,571 | 9/1986 | Lees | 405/251 |
| 4,668,119 | 5/1987 | Galletti | 405/251 X |
| 4,832,535 | 5/1989 | Crambes | 405/266 |

*Primary Examiner*—David Bagnell
*Assistant Examiner*—Tara L. Mayo
*Attorney, Agent, or Firm*—Christensen O'Connor Johnson & Kindness

[57] ABSTRACT

A micropile (40) having an improved attachment to a concrete footing (56). The micropile (40) includes a novel top connector (50) attached to a shortened top casing segment (52*d*). The shortened top casing segment (52*d*) is attached to the other segments (52*a–b*) of the casing 52 for the micropile (40) by a casing coupler (62). The casing coupler (62) is located just below the concrete footing (56) for the micropile (40).

8 Claims, 4 Drawing Sheets

MICROPILE CASING AND METHOD

FIELD OF THE INVENTION

This invention relates to underground reinforcement of structures and, more specifically, to an improved pile for reinforcing a structure.

BACKGROUND OF THE INVENTION

A pile is a heavy beam of timber, concrete, or steel that extends into the earth and serves as a foundation or support for a structure. Piles are divided into two general categories: displacement piles and replacement piles. Displacement piles are members that are driven or vibrated into the ground, thereby displacing the surrounding soil laterally during installation. Replacement piles are placed or constructed within a previously drilled hole, thus replacing the excavated ground.

A micropile is a small diameter (typically less than 300 millimeters) replacement pile. Micropiles are used mainly for foundation support of a structure to resist static and seismic loading conditions. Over the last several years, micropiles have become popular for use in commercial buildings and transportation structures. Micropiles are also used as in-situ reinforcements for slope and excavation stability.

Micropiles withstand axial as well as lateral loads and may be considered as a substitute for conventional piles or as one component in a composite soil/pile mass, depending on the design concept employed. Micropiles are installed by methods that cause minimal disturbance to structure, soil, and the environment. The small size of the machinery required for installing micropiles permits installation of micropiles in locations having limited access and low head room. This advantage permits the micropiles to be installed within existing structures.

To form a typical micropile, a hole is drilled, reinforcing steel is placed into the hole, and the hole is filled with mortar, or "grout". The process of filling the hole with the grout is called "grouting". A construction sequence of a typical micropile 10 is shown in FIGS. 1A–F. Installation begins by drilling a hole 12 and inserting a casing 14 in the hole. The casing 14 shown in FIGS. 1A–F consists of three elongate, hollow, cylindrical casing segments 14*a–c* attached end-to-end.

Installation of the casing 14 occurs simultaneous with the drilling of the hole. This occurs because the first casing segment 14*a* induces cutting teeth (not shown, but well known in the art) at its bottom end. To prepare for drilling, the first casing segment 14*a* attached to a drill rig (not shown, but well known in the art) and is rotated into the ground. In difficult soil conditions, an internal drill rod 18 with a drill bit 16 on a distal end can be advanced with the casing 14 to aid in drilling. The first casing segment 14*a* extends around the drill rod 18 and abuts against the backside of the drill bit 16.

Once the first casing segment 14*a* is in place, the drill rig is prepared for drilling. The first casing segment 14*a* is drilled to a depth that is less than the length of the first casing segment 14*a* (FIG. 1A).

A second casing segment 14*b* is attached to the end of the first casing segment 14*a* by threading an external set of threads in the end of the second casing segment 14*b* into internal threads on the top end of the first casing segment 14*a*. Alternatively, the segments of a casing 14 can be attached to one another by a casing coupler (not shown in FIGS. 1A–F, but well known in the art). A casing coupler is a cylindrical, hollow element with internal threads on opposite ends. If the casing coupler is used, both ends of each of the casing segments will have external threads. The external threads on the top end of the first casing segment are threaded into one end of the casing coupler, and the external threads of an adjacent casing segment are threaded into the opposite end of the casing coupler.

After the second casing segment 14*b* is attached to the first casing segment 14*a*, drilling continues until the top edge of the second casing segment 14*b* is adjacent to the ground. A third casing segment 14*c* is attached to the end of the second casing segment 14*b*. This process is continued until the casing 14 extends completely through the upper, looser portions of the soil base (called the "less competent stratum" and designated generally by the numeral 20 in FIGS. 1A–F), and into the solid under-soil (called the "bearing stratum" and designated generally by the numeral 22 in FIGS. 1A–F) (FIG. 1B). Any number of casing may be used to reach the required depth. However, for simplicity, only three casing segments 14*a–c* are shown in FIGS. 1A–F.

After the casing 14 is in place, the drill rod 18 and drill bit 16 are pulled out of the casing 14 (FIG. 1C). Reinforcements 24, such as steel rebar, are placed down the length of the inside of the casing. The reinforcements 24 can occupy as much as one half the internal volume of the casing 14. After the reinforcements 24 are placed in the casing 14, grout 26 is introduced into the casing by tremie (not shown, but well known in the art) (FIG. 1D).

After the casing 14 is filled with grout 26, the casing 14 is backed out of the drilled hole 12. Further grout 26 is added under pressure to the casing 14 while the casing is being withdrawn so that the hole 12 left by the casing 14 is filled with grout 26 (FIG. 1E). The pressurized grouting and withdrawal of the casing continues until the bottom edge of the casing is adjacent to the top edge of the embedment length in the bearing stratum 22. Casing segments are removed as the casing 14 is withdrawn from the hole 12. In the sequence shown in FIGS. 1A–F, only the third casing segment 14*c* is detached from the casing 14, and the top end of the second casing segment 14*b* extends out of the ground after grouting is complete. Preferably, the pressure used during the grouting process is adequate so that the grout 26 is pressed against the inner surface of the hole 12 so as to create a consistent grout/ground bond. The remaining portion of the casing 14 is left in place through the less competent stratum 20 after the pressurized grouting. After grouting, the casing 14 is typically reinserted a set distance into the top portion of the pressure grouted length, allowing a structural transition between the upper encased and lower uncased portions of the pile.

Finally, steel plates 28 (FIG. 1F) are welded to the top of the casing 14. In the casing 14 shown in FIGS. 1A–F, the steel plate 28 is welded to the top of the second casing segment 14*b*. A concrete footing 30 is cast around the steel plate 28 and the top end of the casing 14. The micropile 10 is now complete.

The structural capacity of the micropile 10 depends largely on the strength of the elements used as the reinforcements 24 and the casing 14. The reinforcements 24 and the casing 14 are typically formed of high transition strength steel, and are designed to resist most or all of the applied load on the micropile 10.

The reinforcements 24 transfer the load applied to the micropile 10 through the grout to the bearing stratum 22. An effective transfer of the applied load can only occur if the micropile 10 is sufficiently anchored in the concrete footing 30 and the bearing stratum 22. The drilling and grouting methods used in the micropile 10 installation allow high grout/ground bond values to be generated along the grout/bearing stratum interface, and properly anchor the micropile in the bearing stratum 22.

Anchoring of the reinforcement 24 and the casing 14 to the concrete footing 30 is provided primarily by the steel plates 28. Thus, the welded connection between the casing 14 and the steel plates 28 serves a vital function for the anchoring of the casing in the concrete footing 30. It has been found that welding of the steel plates 28 to the top end of the casing 14 decreases the ductility of the high-capacity steel in the casing 14 in the areas of the casing affected by the heat of the weld. This less ductile, heat-affected steel can cause a premature failure of the casing steel at the attachment to the steel plates 28. There exists a need for a better structure for anchoring a high strength steel casing to a concrete footing.

During a seismic event (earthquake), lateral movement of the footing 30 can induce a curvature in the portion of the pile 10 below the footing in the less competent stratum 20. This curvature creates a bending moment and stresses in the pile casing, which are greatest in the length of the casing just below the footing. Lateral displacements which induce bending can also occur in applications where the micropile is used as a component of an earth stabilization system. In these applications, the bending moment is greatest at the slide plane of the micropile. There exists a need for a structure that can reinforce the casing threaded joint where the casing is subject to larger bending stresses.

SUMMARY OF THE INVENTION

The present invention provides a pile for connecting a structure to underlying soil. The pile includes a footing connected to the structure, the footing defining a bottom. A casing extends from the footing into underlying soil. The casing includes a plurality of casing segments attached end-to-end. The uppermost casing segment extends into the footing through the bottom of the footing. The pile includes a casing coupler that attaches the uppermost casing segment to an adjacent casing segment. The casing coupler is located substantially outside the footing in the location where bending reinforcement of the joint is required.

In accordance with further aspects of the invention, the uppermost casing segment further includes external threads. A ring is threaded onto the external threads and is anchored in the footing.

In accordance with still further aspects of the invention, a plurality of rings are threaded onto the external threads and are anchored in the footing.

In accordance with yet other aspects of the invention, a pile for connecting a structure to underlying soil is provided. The pile includes a footing connected to the structure, the footing defining a bottom. A casing extends from the footing into underlying soil. The casing includes having a plurality of casing segments attached end-to-end. The uppermost casing segment extends into the footing through the bottom of the footing and includes external threads. A ring is threaded onto the external threads of the uppermost casing segment and is anchored in the footing.

In accordance with yet another aspect of the invention, a method for installing a pile between a structure and an underlying soil is provided. The method includes drilling a hole and installing a casing in the hole from adjacent the structure into underlying soil. The casing includes a plurality of casing segments attached end-to-end. Each of the casing segments, once installed, are located at least partly within the hole. After the casing is installed, a portion of the casing is withdrawn from the hole so that at least one of the casing segments is substantially removed from the hole. The at least one casing segment is then removed from the casing. The casing remaining in the hole and the portion of the hole from which the casing was withdrawn are grouted, and a casing coupler is attached to the end of the casing closest to the structure. An uppermost casing segment is attached to the casing coupler and a footing is casted around the uppermost casing segment and connected to the structure, the footing defining a bottom. The footing is arranged such that the casing coupler is substantially outside the footing and adjacent to the bottom of the footing. Alternatively, the casing coupler is installed with the casing where required by joint strength considerations.

In accordance with still further aspects of the present invention, the uppermost casing segment includes external threads, and the method described above includes threading at least one ring on the external threads of the uppermost casing segment prior to casting the footing. The casting occurs around the at least one ring. The step may further include threading a plurality of rings on the external threads of the uppermost casing segment prior to casting the footing and casting around the plurality of rings.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1A shows insertion of a first casing segment into the ground with part of the casing segment removed for detail;

FIG. 1B shows three casing segments inserted into the ground to form a casing, with part of each of the casing segments removed for detail;

FIG. 1C shows the three casing segments of FIG. 1B inserted into the ground with a drill rod removed;

FIG. 1D shows the three casing segments of FIG. 1B with part of each of the casing segments removed for detail and with reinforcements and grout added to the hole and the casing;

FIG. 1E shows two of the casing segments of FIG. 1B as partially withdrawn from the hole and with pressurized grout filling the part of the hole from which the casing was removed, with part of each of the casing segments removed for detail;

FIG. 1F shows the two casing segments of FIG. 1E, with the top portion of the top casing segment anchored in a concrete footing;

DETAILED DESCRIPTION OF THE PREFERRED EMBODIMENT

Figure 2:
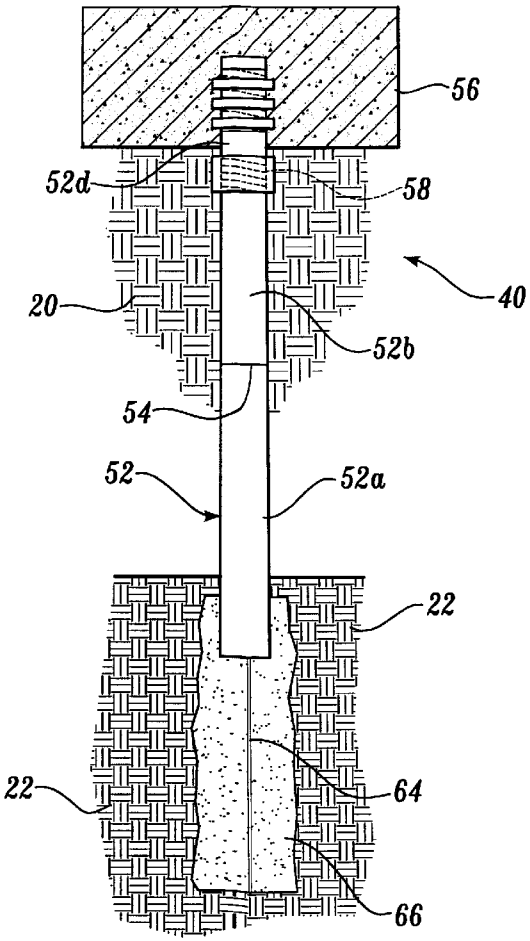
FIG. 2 shows a diagrammatic view of a micropile embodying the present invention.

Referring now to the drawing, in which like reference numerals represent like parts throughout the several views, FIG. 2 shows a micropile 40 embodying the present invention. The micropile 40 includes a casing 52, formed from three casing segments 52*a, b, d*. The top end of the casing 52 extends into a concrete footing 56.

Briefly described, the beginning steps for installation of the micropile 40 are in accordance with the description relating to FIGS. 1A–D in the Background Section of this disclosure. However, unlike the micropile 10 described in the Background Section of this disclosure, the micropile 40 includes a novel shortened top casing segment 52*d*. The shortened top casing segment 52*d* is attached to the other segments 52*a–b* of the casing 52 for the micropile 40 by a casing coupler 58. The casing coupler 58 is located just below the concrete footing 56 of the micropile 40.

Figure 3:
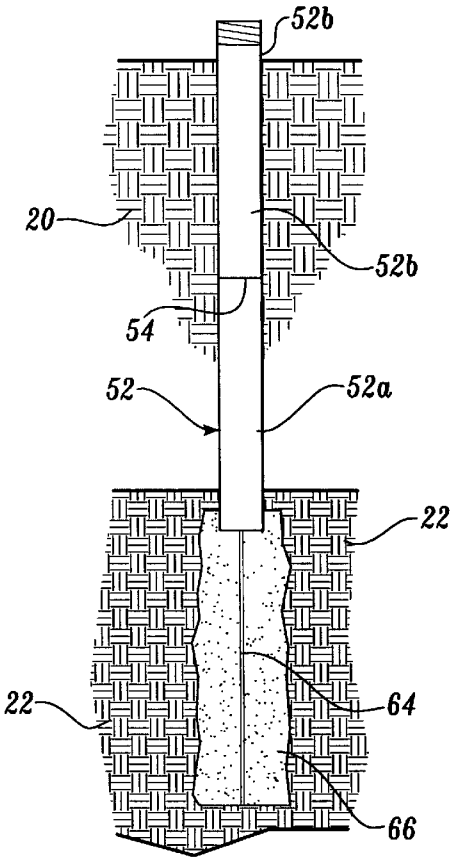
FIG. 3 shows an early assembly stage of the micropile of FIG. 2, with the casing being partially withdrawn from the hole and with grout filling the part of the hole from which the casing was removed, two of the three casing segments still in the hole and a third, temporary casing segment removed from the end of the casing.

As with the micropile 10 described the Background Section of this disclosure, installation of the micropile 40 begins by drilling a hole and inserting three casing segments 52*a–b* in the hole (the third casing segment is not shown, but is similar to the casing segment 14*c* described in the Background section of this disclosure). It is to be understood that any number of casing segments can be used to extend the casing the necessary depth. However, for simplicity, the casing 52 shown in FIG. 3 is installed with three elongate, hollow, cylindrical casing segments 52*a–b* attached end-to-end.

The second casing segment 52*b* is attached to the first casing segment 52*a* by threading an external set of threads (not shown, but well known in the art) in the end of the second casing segment 52*b* onto an internally-threaded end of the first casing segment 52*a*. The second casing segment 52*b* includes internal threads (not shown, but well known in the art) at its top end. The third casing segment (not shown) of the casing 52 also includes external threads that are thread onto the internal threads on the top of the second casing segment 52*b*.

As described above, more than three casing segments can be used for the casing 52. It is preferred that the final length of the casing 52 be sufficient to extend completely through the less competent stratum 20 and into the bearing stratum 22. The connection of each of the segments can be by threading segment into segment as described above so as to form casing joints 54. Alternatively, each of the casing segments 52*a–b* may be provided with external threads on each end, and the connections can be made by casing couplers.

After the casing segments 52*a–c* are in place, reinforcements 64, such as steel rebar, are placed down the length of the inside of the casing 52. The reinforcements 64 can occupy as much as one half the internal volume of the casing 52. After the reinforcement 64 is placed in the casing 14, grout 66 is introduced into the casing by tremie (not shown, but well known in the art).

After the casing 52 is filled with grout 66, the casing 52 is backed out of the drilled hole. Further grout 66 is added under pressure to the casing 52 while the casing is being withdrawn so that the hole left by the casing is filled with grout 66 (FIG. 3). The pressurized grouting and withdrawal of the casing 52 continues until the bottom edge of the casing is adjacent to the top edge of the embodiment length in the bearing stratum 20. Casing segments are removed as the casing 52 is withdrawn from the hole. In the sequence described in this preferred embodiment, only the third casing segment is detached from the casing 52, and the top end of the second casing segment 52*b* extends slightly out of the ground after withdrawal of the casing is complete.

Figure 1C:
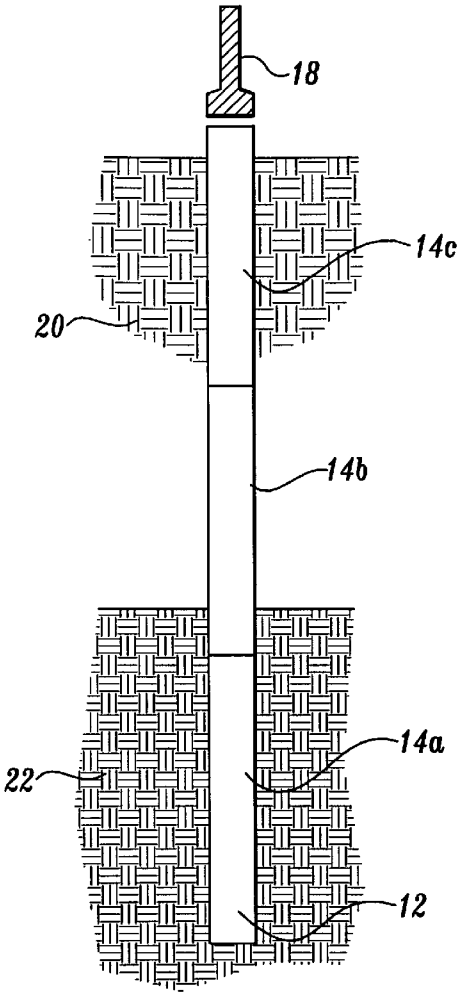
Fig. 1C. (PRIOR ART)
FIGS. 1A–F show a diagrammatic view of a prior art micropile construction sequence.
Figure 1B:
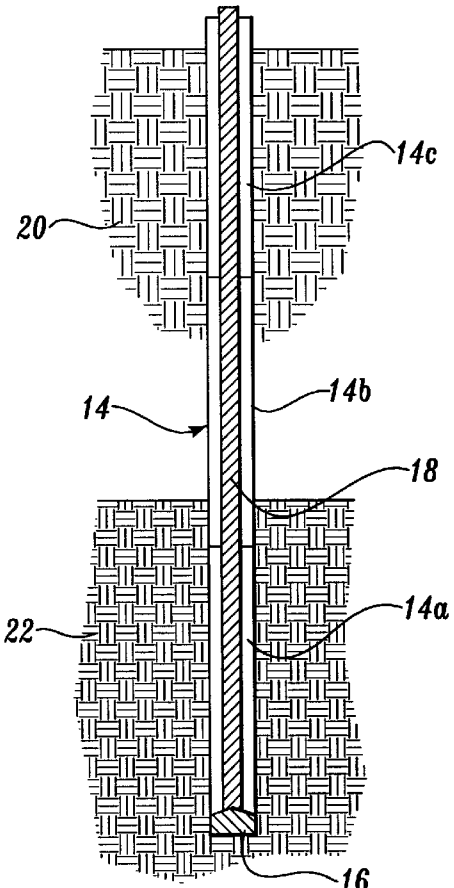
Fig. 1B. (PRIOR ART)
Figure 1A:
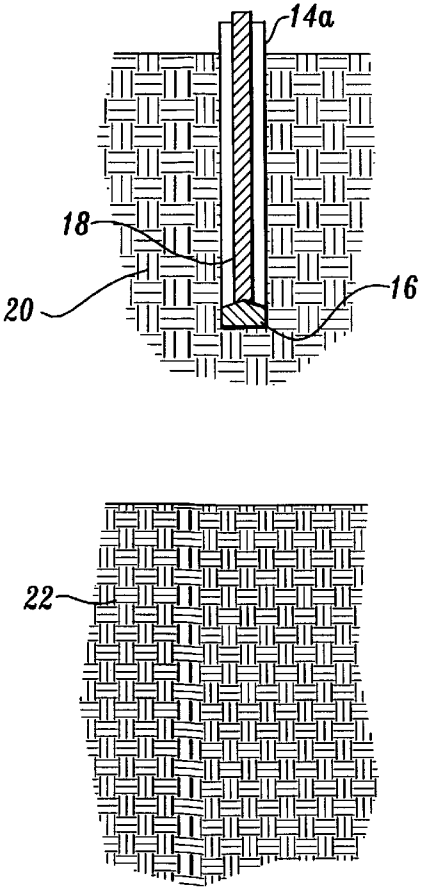
Fig. 1A. (PRIOR ART)
Figure 1F:
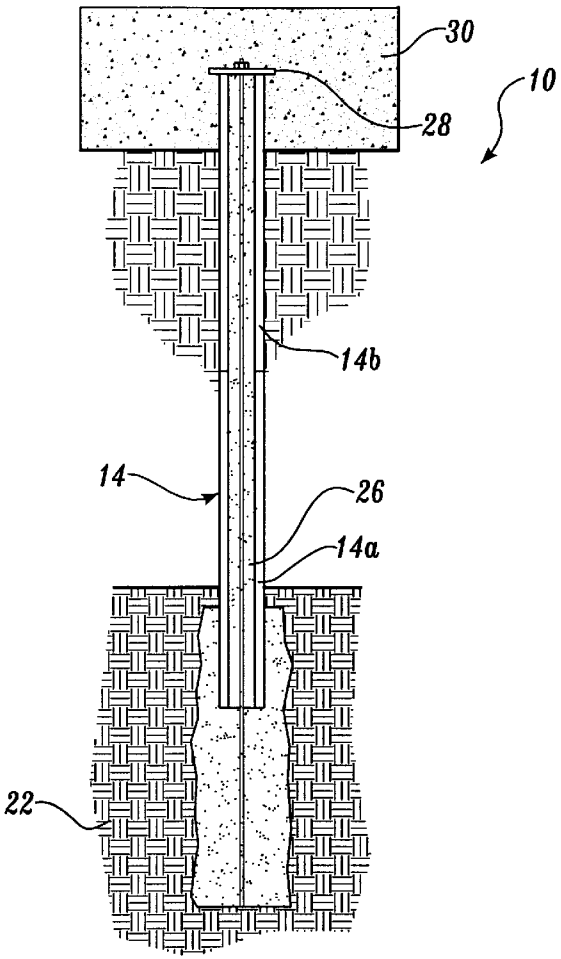
Fig. 1F. (PRIOR ART)
Figure 1E:
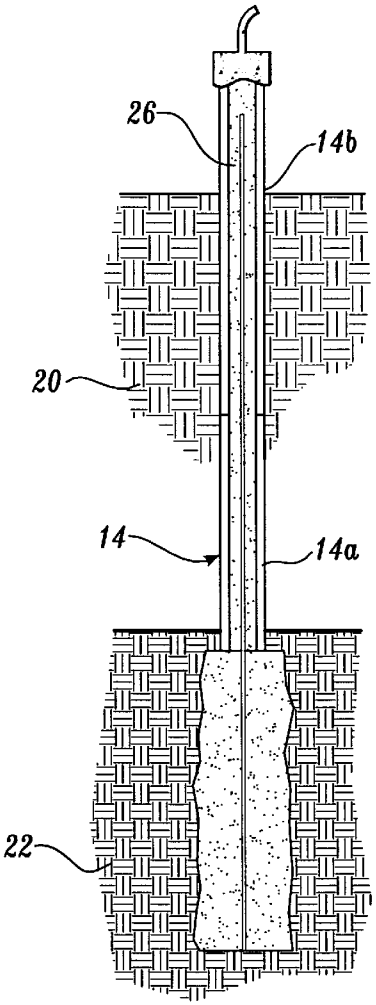
Fig. 1E. (PRIOR ART)
Figure 1D:
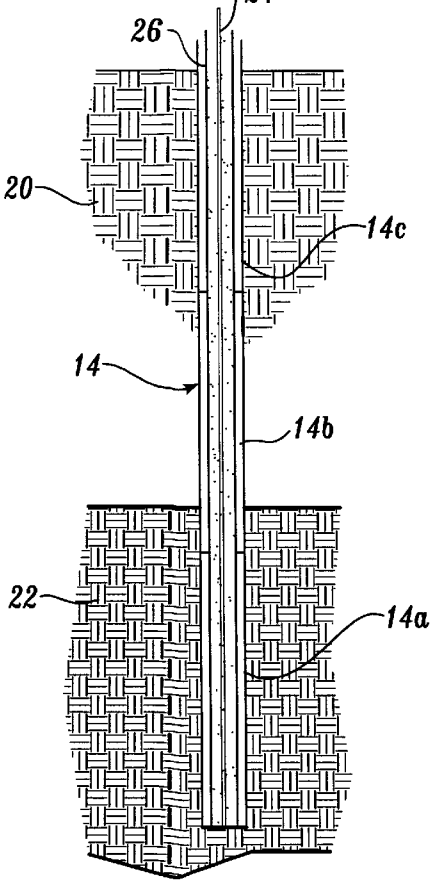
Fig. 1D. (PRIOR ART)
Figure 4:
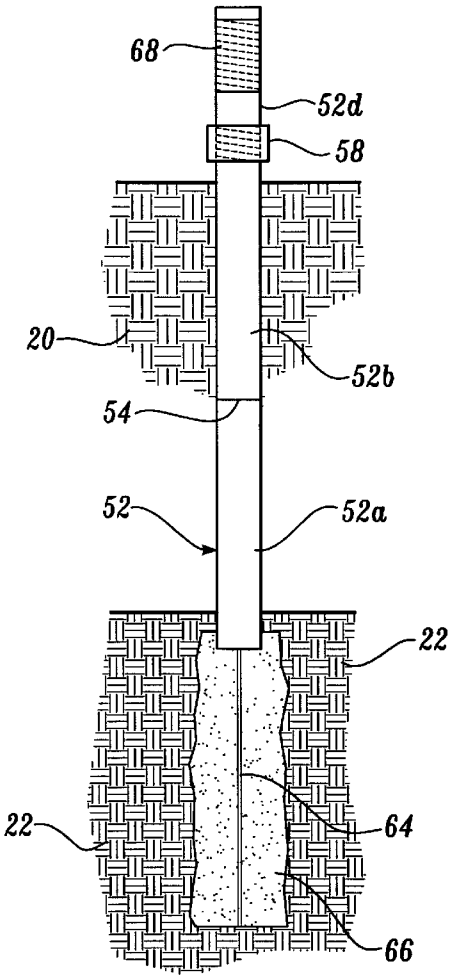
FIG. 4 shows a further stage of assembly of the micropile of FIG. 2, with a casing coupler and shortened top casing segment added to the casing.
Figure 5:
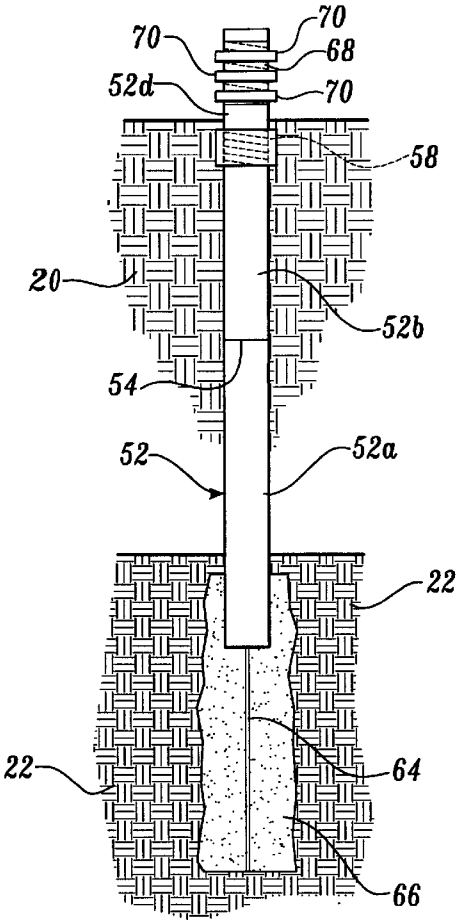
FIG. 5 shows a further stage of assembly of the micropile of FIG. 2, with a casing coupler pressed into the ground and with a concrete footing cast around the shortened top casing segment.

The third casing segment is then detached from the rest of the casing 52. The casing coupler 58 (FIG. 4) is threaded onto the end of the second casing segment 52*b*. One end of the shortened top casing segment 52*d* includes external threads that are threaded into the internal threads at the opposite end of the casing coupler 58. The casing 52 is then reinserted into the ground by the drilling equipment (not shown, but well known in the art) until the casing coupler 58 is below the bottom of the level to which the bottom of the concrete footing 56 will extend. (FIG. 5).

The top end of the shortened top segment 52*d* of the casing 52 extends out of the hole an appropriate amount to anchor the casing within the concrete footing 56. The top end of the shortened top casing segment 52*d* includes large external threads 68. A number of large thread-on steel plates or rings 70 are threaded onto the threads 68 on the shortened top casing segment 52*d* (FIG. 5). The steel rings 70 are spaced along the length of the threads 68.

After the thread-on steel rings 70 are threaded onto the threads 68 on the shortened top casing segment 52*d*, the concrete footing 56 is cast into place around the thread-on steel rings 70 and the top end of the casing 52. The concrete footing 56 is cast such that the casing coupler 58 is located just below the bottom edge of the concrete footing 56.

The thread-on steel rings 70 permit quick and easy final installation of the micropile 40. The thread-on steel rings 70 can easily be placed on the end of the casing 52 so that the concrete footing 56 may be cast around the rings. No welding of the thread-on steel rings 70 to the casing is required. Each of the individual thread-on steel rings 70 provides a separate anchor for the casing 52 within the concrete footing 56.

Locating the casing coupler 58 just below the concrete footing 56 and substantially outside the concrete footing reinforces the casing 52 at the portion of the casing that is subject to maximum bending stress. In this manner, the casing coupler 58 prevents damage to the casing 52 at this location.

Figure 6:
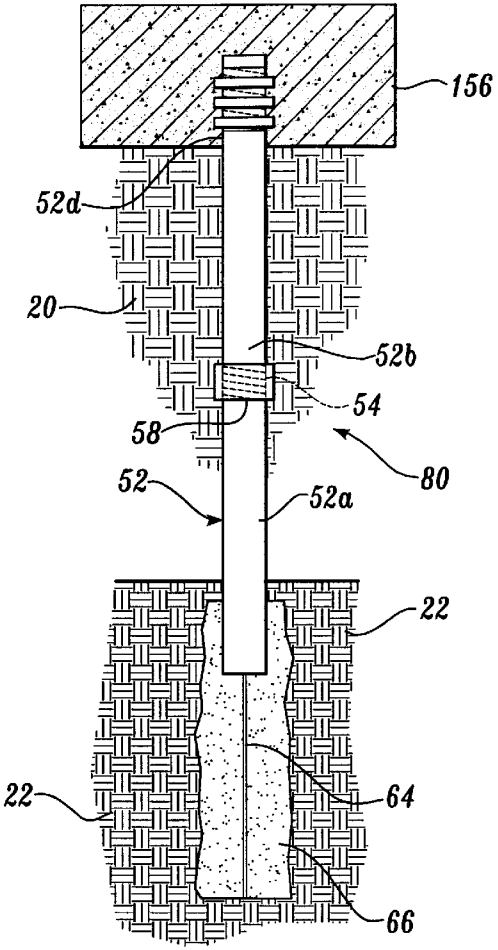
FIG. 6 shows a second micropile embodying the present invention, the micropile shown as installed in an underlying soil.

The micropile 40 can also be used for retaining walls and slope stabilization. In these installations, the location of maximum bending stress removed from the concrete footing 56 is located further down into the casing 52. By performing soil fists, the slide plane 80 (FIG. 6) of a soil area may be determined. After this value is determined, an operator of the drill rig installs casing couplers in the joints of the casing that will be adjacent to the slide plane. If casing couplers 58 are required for lower casing joints, they will be installed with the casing 52 as it is drilled into the ground. The renewing structure of the micropile is typically the same as described above, with the top of the casing cast into a concrete cap beam 156.

While this invention has been described in detail with particular reference to preferred embodiments thereof, it will be understood that variations and modifications can be effected within the spirit and scope of the invention as described hereinbefore and as defined in the appended claims.

The embodiments of the invention in which an exclusive property or privilege is claimed are defined as follows:

1. A pile for connecting a structure to underlying soil, the pile comprising:

(a) a footing adapted to connect to the structure, the footing having a bottom surface;

(b) a tubular casing with an upper end and a lower end, the casing upper end being fully embedded within the footing, the casing lower end adapted to being fully embedded in the underlying soil, the casing comprising a plurality of casing segments attached end-to-end, including (i) a first casing segment having a first end that provides the casing upper end and that includes exterior threads, and having a second end that extends out the footing bottom surface;

(ii) a second casing segment having a first end; and (iii) a number of remaining casing segments;

(c) a casing coupler mechanically connecting the first casing segment second end with the second casing segment first end via threaded mating surfaces, the casing coupler being located substantially outside the footing and near the bottom surface of the footing; and (d) at least one ring threaded onto the first casing segment first end, the at least one ring being sized to be fully embedded within the footing effectively anchoring the casing to the footing.

2. The pile of claim 1, where the at least one ring includes a plurality of rings that are threaded onto the external threads and that are each fully anchored and embedded in the footing.

3. The pile of claim 1, wherein the first casing segment second end and the second casing segment first end comprise integral external threads and the casing coupler comprises internal threads for mating with the external threads of the first and second casing segments.

4. The pile of claim 1, wherein the footing is a cap beam.

5. A method for installing a pile between a structure and an underlying soil, comprising:

drilling a hole from adjacent the structure into an underlying soil;

installing a tubular casing in the hole, the casing comprising a plurality of casing segments attached end-to-end, each of the casing segments, once installed, being located at least partly within the hole;

withdrawing a portion of the casing from the hole so that at least one of the casing segments is substantially removed from the hole;

removing the at least one casing segment from the casing to leave the adjacent casing end exposed;

grouting the casing remaining in the hole and the portion of the hole from which the casing was withdrawn, the hole being located below the casing;

attaching a casing coupler to the exposed casing end;

mechanically attaching one end of a first casing segment to the casing coupler via threaded mating surfaces;

attaching at least one ring around the other end of the first casing segment; and after attaching the at least one ring, casting a footing around the combination of the first casing segment and the attached at least one ring, the footing defining bottom surface, the footing being arranged such that the casing coupler is located substantially outside the footing and adjacent to the bottom surface of the footing, the footing further being arranged such that the at least one ring is fully embedded within the footing.

6. The method of claim 5, wherein the at least one ring is a plurality of rings.

7. The method of claim 5, wherein the first casing segment and the exposed casing segment end comprise integral external threads and the casing coupler comprises internal threads for mating with the external threads of the first and exposed casing segments, and wherein attaching a casing coupler to the end of the casing closest to the structure comprises threading the casing coupler onto the end of the casing, and wherein mechanically attaching the one end of a first casing segment to the casing coupler comprises threading the first casing segment into the casing coupler.

8. The method of claim 5, wherein the footing is a cap beam.

* * * * *

UNITED STATES PATENT AND TRADEMARK OFFICE

CERTIFICATE OF CORRECTION

PATENT NO. : 6,012,874
DATED : January 11, 2000
INVENTOR(S) : P.B. Groneck et al.

It is certified that error appears in the above-identified patent and that said Letters Patent is hereby corrected as shown below:

On the title page item [75] inventors "Thomas A. Amour" should --Thomas A. Armour--

Signed and Sealed this

Sixth Day of February, 2001

*Attest:*

*Attesting Officer*

Q. TODD DICKINSON

*Director of Patents and Trademarks*